US007880684B2

(12) United States Patent
Schantz

(10) Patent No.: US 7,880,684 B2
(45) Date of Patent: Feb. 1, 2011

(54) SMALL APERTURE BROADBAND LOCALIZING SYSTEM

(75) Inventor: Hans Gregory Schantz, Huntsville, AL (US)

(73) Assignee: Next-RF, Inc., Huntsville, AL (US)

( * ) Notice: Subject to any disclaimer, the term of this patent is extended or adjusted under 35 U.S.C. 154(b) by 909 days.

(21) Appl. No.: 11/789,088

(22) Filed: Apr. 23, 2007

(65) Prior Publication Data

US 2007/0195005 A1 Aug. 23, 2007

Related U.S. Application Data

(63) Continuation-in-part of application No. 11/235,259, filed on Sep. 26, 2005, now Pat. No. 7,391,383, and a continuation-in-part of application No. 10/714,046, filed on Nov. 14, 2003, now Pat. No. 6,950,064, application No. 11/789,088, which is a continuation-in-part of application No. 11/455,425, filed on Jun. 19, 2006, now Pat. No. 7,439,924, and a continuation-in-part of application No. 10/965,921, filed on Oct. 15, 2004, now Pat. No. 7,064,723, application No. 11/789,088, which is a continuation-in-part of application No. 11/474,770, filed on Jun. 26, 2006, now Pat. No. 7,221,323, and a continuation-in-part of application No. 11/010,083, filed on Dec. 11, 2004, now Pat. No. 7,068,225, application No. 11/789,088, which is a continuation-in-part of application No. 11/040,077, filed on Jan. 21, 2005, now Pat. No. 7,209,089, application No. 11/789,088, which is a continuation-in-part of application No. 11/214,096, filed on Aug. 29, 2005, now abandoned.

(60) Provisional application No. 60/438,724, filed on Jan. 8, 2003, provisional application No. 60/433,637, filed on Dec. 16, 2002, provisional application No. 60/512,872, filed on Oct. 20, 2003, provisional application No. 60/529,064, filed on Dec. 12, 2003, provisional application No. 60/538,187, filed on Jan. 22, 2004, provisional application No. 60/607,441, filed on Sep. 3, 2004.

(51) Int. Cl.
*H01Q 21/00* (2006.01)

(52) U.S. Cl. ..... 343/867; 343/795; 340/572.7

(58) Field of Classification Search ..... 343/867, 343/793, 767, 795; 342/445, 447; 340/572.7
See application file for complete search history.

(56) References Cited

U.S. PATENT DOCUMENTS 5,589,838 A 12/1996 McEwan (Continued)

OTHER PUBLICATIONS

Schantz, "On the Origins of RF-Based Location," submitted to 2011 IEEE Radio&Wireless Symposium, Phoenix, AZ, Jan. 16-20, 2011.

(Continued)

*Primary Examiner*—Tan Ho

(57) ABSTRACT

The present invention is directed to a small aperture broadband localizing system, comprising one or more systems for ascertaining angle-of-arrival of an electromagnetic signal and a transmit tag. A system for ascertaining angle-of-arrival of an electromagnetic signal further comprises a compact antenna array and an evaluation apparatus, and an electromagnetic signal is preferentially a broadband or ultra-wideband (UWB) signal.

8 Claims, 6 Drawing Sheets

U.S. PATENT DOCUMENTS

| | | | | |
|---|---|---|---|---|
| 6,054,950 | A | 4/2000 | Fontana | |
| 6,111,536 | A | 8/2000 | Richards et al. | |
| 6,133,876 | A | 10/2000 | Fullerton et al. | |
| 6,400,307 | B2 | 6/2002 | Fullerton et al. | |
| 6,493,649 | B1 | 12/2002 | Jones et al. | |
| 6,674,396 | B2 | 1/2004 | Richards et al. | |
| 6,710,719 | B1 | 3/2004 | Jones et al. | |
| 6,760,387 | B2 | 7/2004 | Langford et al. | |
| 6,824,480 | B2 | 11/2004 | John et al. | |
| 6,882,315 | B2 | 4/2005 | Richley et al. | |
| 6,922,160 | B1 | 7/2005 | Brown | |
| 7,038,589 | B2 | 5/2006 | Schmidt et al. | |
| 7,043,999 | B2 * | 5/2006 | Bernhard et al. | 73/801 |
| 7,130,243 | B2 | 10/2006 | Koets | |
| 7,609,164 | B2 * | 10/2009 | Yamashita | 340/572.7 |

OTHER PUBLICATIONS

Schantz, "RF-Based Location Since World War II," submitted to 2011 IEEE Radio&Wireless Symposium, Phoenix, AZ, Jan. 16-20, 2011.

* cited by examiner

SMALL APERTURE BROADBAND LOCALIZING SYSTEM

This application is a continuation-in-part of a U.S. patent application titled "Tag-along microsensor device and method," filed Jun. 26, 2006 as application Ser. No. 11/474,770 (published Oct. 26, 2006 as US 2006/0238422 A1), which is in turn a continuation-in-part of applicant's "Nano-antenna apparatus and method," filed Dec. 11, 2004 as Ser. No. 11/010,083 (issued Jun. 27, 2006 as U.S. Pat. No. 7,068,225 B2), which claims benefit under 35 USC 119(e) of prior filed copending provisional patent application Ser. No. 60/529,064 filed Dec. 12, 2003. All of the above cited applications are incorporated herein by reference.

The present application is also a continuation-in-part of a U.S. patent application titled: "Chiral polarization ulatrawideband slot antenna," filed Sep. 26, 2005 as application Ser. No. 11/235,259 (published Feb. 9, 2006 as US 2006/0028388 A1), which is in turn a continuation-in-part of a U.S. patent application titled: "System and method for ascertaining angle of arrival of an electromagnetic signal," filed Nov. 14, 2003, Ser. No. 10/714,046, (issued Sep. 27, 2005 as U.S. Pat. No. 6,950,064 B2), which further claims the benefit of prior filed copending Provisional Patent Application Ser. No. 60/433,637, filed Dec. 16, 2002, and claims benefit under 35 USC 119(e) of prior filed copending Provisional Patent Application Ser. No. 60/438,724, filed Jan. 8, 2003. All of the above cited applications are incorporated herein by reference.

The present application is further a continuation-in-part of a U.S. patent application titled: "Offset overlapping slot line antennas," filed Jun. 19, 2006 as application Ser. No. 11/455,425 (published Nov. 2, 2006 as U.S. 2006/0244674), which is in turn a continuation-in-part of a U.S. patent application titled: "Spectral control antenna apparatus and method," filed Oct. 15, 2004, as Ser. No. 10/965,921 (since issued Jun. 20, 2006 as U.S. Pat. No. 7,064,723), which further claims benefit under 35 USC 119(e) of prior filed co-pending Provisional Patent Application Ser. No. 60/512,872 filed Oct. 20, 2003. All of the above cited applications are incorporated herein by reference.

In addition, the present application is a continuation-in-part of a U.S. patent application titled: "Broadband electric-magnetic antenna apparatus and method," filed Jan. 21, 2005 as Ser. No. 11/040,077 (since published Jul. 28, 2005 as US 2005/0162332 A1) which further claims benefit under 35 USC 119(e) of prior filed co-pending Provisional Patent Application Ser. No. 60/538,187 filed Jan. 22, 2004. All of the above cited applications are incorporated herein by reference.

Finally, the present application is a continuation-in-part of a U.S. patent application titled: "System and method for directional transmission and reception of signals," filed Aug. 29, 2005 as Ser. No. 11/214,096 (since published Mar. 6, 2006 as U.S. 2006/0049991) which further claims benefit under 35 USC 119(e) of prior filed co-pending Provisional Patent Application Ser. No. 60/607,441 filed Sep. 3, 2004. All of the above cited applications are incorporated herein by reference.

BACKGROUND OF THE INVENTION

The present invention is directed to a small aperture broadband localizing system. A wide variety of attempts exist in the prior art to solve the challenging problem of localizing a broadband or ultra-wideband transmitter so as to enable a real-time location system.

Some attempts rely on a complicated transponder ranging tag that receives and replies to an interrogating signal allowing a receiver to measure two-way time-of-flight, and thus the range to the tag. Transponder tags require complicated, expensive, and power-hungry integrated receivers, thus precluding this as a viable approach to a low-cost, ubiquitous tag.

Other attempts rely on a transmit-only tag and a network of receivers comparing the differential time-of-arrival (DTOA) of transmitted signals from the tag. This architecture allows for a relatively simple and low-cost tag, but requires a complicated and difficult to receive synchronization within a network of receivers.

Still other attempts have involved a relatively large aperture of two or more receive antennas. Such large-aperture angle-of-arrival techniques yield large and bulky receivers that are not terribly practical in the close confines of most typical indoor propagation environments.

There is a need for a simple, compact, and straightforward system to enable a real-time location system by ascertaining angle-of-arrival of broadband and ultra-wideband (UWB) electromagnetic signals.

There is a further need for a simple, compact, and straightforward system to supplement other real-time location architectures by providing angle-of-arrival of broadband and UWB electromagnetic signals.

There is yet additional need for simple, compact, transmit tag antennas that enable compact, robust, body-mounted transmit tags in a real-time location system.

SUMMARY OF THE INVENTION

Accordingly, one object of the present invention is to provide a simple, compact, and straightforward system to enable a real-time location system by ascertaining angle-of-arrival of broadband and ultra-wideband (UWB) electromagnetic signals. A further object of the present invention is to provide a simple, compact, and straightforward system to supplement other real-time location architectures by providing angle-of-arrival of broadband and UWB electromagnetic signals. Yet another object of the present invention is to provide simple, compact, transmit tag antennas that enable compact, robust, body-mounted transmit tags in a real-time location system.

The present invention is directed to a small aperture broadband localizing system, comprising one or more systems for ascertaining angle-of-arrival of an electromagnetic signal and a transmit tag. A system for ascertaining angle-of-arrival of an electromagnetic signal further comprises a compact antenna array and an evaluation apparatus, and an electromagnetic signal is preferentially a broadband or ultra-wideband (UWB) signal.

In preferred embodiments, a transmit tag antenna has a pattern similar to a cardiod. In alternate embodiments, a transmit tag antenna further includes an overlapping feed region. In still further embodiments, a transmit tag may be a nano-antenna apparatus. A nano-antenna apparatus further comprises a first conducting surface, a second conducting surface, a gap region between a first and second conducting surface, and at least one discharge switch.

A system for ascertaining angle of arrival of an electromagnetic signal having at least one signal characteristic (e.g., phase, polarization, or amplitude) indicating a first state or a second state (e.g., front or back) includes: (a) a plurality of n antenna elements intersecting a common axis and cooperating to establish 2n sectors; each respective sector being defined by two antenna elements and the axis; the signal characteristic indicating the first state on a first side of each antenna element and indicating the second state on a second side of each antenna element; combinations of the signal characteristics in each respective sector uniquely identifying the respective sector; and (b) an evaluation apparatus coupled with the antenna elements and employing the state of the signal characteristic sensed by each of the antenna elements to effect ascertaining angle of arrival to a resolution of at least one respective sector.

This invention exploits an attribute of antennas whose waveforms exhibit a 180 degree phase shift (or an amplitude inversion) in signals received from opposite half-planes. This invention also exploits an attribute of antennas which are sensitive to different polarizations in opposite half-planes. In fact, any antenna with a signal characteristic that changes in response to a first or second state (such as arrival from a front or back side) may be advantageously used by the present invention.

A method for ascertaining angle of arrival of an electromagnetic signal at an antenna structure; the method comprising the steps of: (1) configuring the antenna structure to include a plurality of n antenna elements intersecting a common axis and cooperating to establish 2n sectors; each respective sector of the 2n sectors being defined by two antenna elements of the plurality of n antenna elements and the axis; (2) providing the electromagnetic signal with at least one signal characteristic; the at least one signal characteristic indicating a first state on a first side of each respective antenna element of the n antenna elements and indicating a second state on a second side of each respective antenna element of the plurality of n antenna elements; combinations of signal characteristics in each respective sector uniquely identifying the respective sector; and (3) evaluating the state of signal characteristics sensed by each respective antenna element to effect ascertaining angle of arrival to a resolution of at least one respective sector.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

The principle of reciprocity requires that reception and transmission properties of an antenna be reciprocal so that properties of an antenna are the same whether the antenna is employed for receiving signals or is employed for transmitting signals. Throughout this description, it should be kept in mind that discussions relating to transmitting or transmissions apply with equal veracity to reception of electromagnetic energy or signals, and vice versa. In order to avoid prolixity, the present description will focus primarily on reception characteristics of antennas, with the proviso that it is understood that transmission of energy or signals is also inherently described.

The present invention is directed to a small aperture broadband localizing system. A small aperture system and method for ascertaining angle-of-arrival of broadband signals was first disclosed by the applicant in U.S. Pat. No. 6,950,064 filed Jan. 8, 2003, which is incorporated by reference. Such a system is a critical part of a broadband localizing system because it enables not only ranging, but also an angle-of-arrival (AoA) for more robust and reliable localization than is possible from time-of-arrival (TOA) or differential time-of-arrival (DTOA) ranging systems. Unlike conventional UWB AoA systems that rely on time or phase differences between a bulky system of dispersed antennas, a "small-aperture" AoA system can measure AoA from an antenna system comprising substantially co-located antennas. A "sectorized" array of receive antennas, such as those disclosed by applicant in copending U.S. patent application Ser. No. 11/214,096 also help enable a small aperture broadband localizing system.

A practical broadband localizing system further requires compact, body-mountable transmit antennas, such as those disclosed by the applicant in "Broadband electric-magnetic antenna apparatus and method," filed Jan. 21, 2005 as Ser. No. 11/040,077 which is incorporated by reference. Small transmitter tag size is also critical to a successful broadband localizing system, and applicant's concept of using a tag enclosure as an antenna (as disclosed in U.S. Pat. No. 7,068,225) provides great utility in the present context.

Finally, a broadband localizing system by its very broadband nature is vulnerable to interference from co-located signals. Antenna spectral control techniques, such as those disclosed in applicant's U.S. Pat. No. 7,064,723 make a broadband localizing system more robust.

Figure 1:
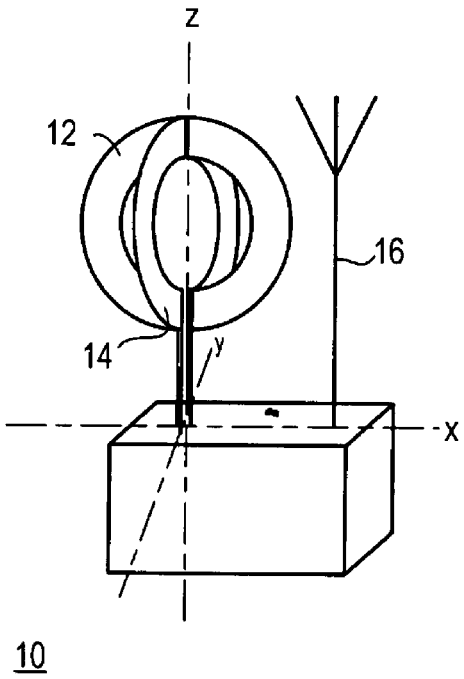
FIG. 1 (PRIOR ART)
FIG. 1 is a schematic diagram of a representative prior art antenna array useful for radio direction finding operations.

FIG. 1 is a schematic diagram of a representative prior art antenna array useful for radio direction finding operations. In FIG. 1, a radio direction finding antenna array 10 includes a first vertically oriented loop antenna element 12 arranged substantially perpendicular with a first axis "y" and a second vertically oriented loop antenna element 14 arranged substantially perpendicular with a second axis "x". Axes x, y are typically orthogonal axes. Antenna elements 12, 14 intersect at a vertical axis "z" that is perpendicular with axes x, y.

Each of loop antennas 12, 14 has a typical "doughnut" antenna pattern well known to experienced practitioners of the antenna arts. Such a "doughnut" pattern establishes minimal sensitivity to signals arriving along an axis perpendicular with the plane of the antenna element and maximally sensitive along axes lying in the plane of the antenna element. Such an antenna pattern has "front-back ambiguity". Angle of arrival of an electromagnetic signal at such a front-back ambiguous antenna element can only be determined with 180 degree accuracy. To overcome such front-back ambiguity an omnidirectional antenna 16 is typically used with vertical loop antennas 12, 14 to unambiguously indicate whether a sensed signal (not shown in FIG. 1) arrives from the "front" or from the "back" of a respective antenna array.

Figure 2:
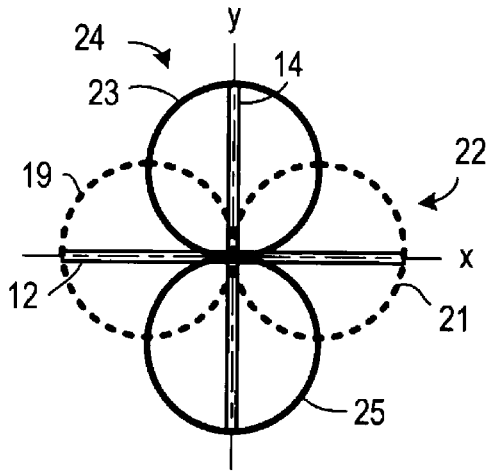
FIG. 2 is a schematic diagram of electromagnetic signal patterns associated with operating the orthogonal loop antennas illustrated in FIG. 1.

FIG. 2 is a schematic diagram of electromagnetic signal patterns associated with operating the orthogonal loop antennas illustrated in FIG. 1. In FIG. 2, antenna elements 12, 14 are shown in a top view with their associated axes x, y. Antenna pattern 22 is a planar section of the antenna pattern of antenna element 12. Antenna pattern 22 includes loops 19, 21. Antenna pattern 24 is a planar section of the antenna pattern of antenna element 14. Antenna pattern 24 includes loops 23, 25. Planar antennas, such as planar loop antennas 12, 14, are maximally sensitive to signals in the plane of the loop, and minimally sensitive to signals incident along the axis of the loop. That is, antenna element 12 is minimally sensitive to signals arriving along axis y, and antenna element 14 is minimally sensitive to signals arriving along axis x. Antenna patterns 22, 24 are mathematically expressed for two dimensions in the x,y plane as:

$$P(\phi)=\cos^2\phi \quad [1]$$

where, $\phi$=angle of arrival in the x,y plane.

$$P(\phi)=\sin^2\phi \quad [2]$$

where, $\phi$=angle of arrival in the x,y plane.

Antenna patterns 22, 24 may be weightingly summed to create a virtual loop antenna pattern (not shown in FIG. 2) oriented in any direction in the x,y plane. Such "steering" of the response patterns of antenna elements 12, 14 permits maximizing or minimizing a received signal to ascertain its angle of arrival at antenna elements 12, 14.

Another prior art arrangement for ascertaining angle of arrival of electromagnetic signals at antenna elements 12, 14 is to effect amplitude comparison of signals received at antenna elements 12, 14 and employing the relationship:

$$\varphi = \tan^{-1}\frac{|A_2|}{|A_1|} \quad [3]$$

Expression [3] will only yield a magnitude for a value of angle of arrival $\phi$. That is, expression [3] can only produce a solution within a 180 degree range; it describes antenna elements 12, 14 with "front-back ambiguity". It is for this reason that sense antenna 16 (FIG. 1) is employed with radio direction finding antenna array 10 (FIG. 1). An omnidirectional antenna 16 operates as a sense antenna to provide directional input to the solution provided by expression [3], thereby resolving the front-back ambiguity suffered by antenna elements 12, 14. An omnidirectional antenna may be thought of as providing a sign for the solution of expression [3] to enable determination of angle of arrival of signals at antenna elements 12, 14 for a full 360 degree range.

A consequence of the requirement for both loop antennas 12, 14 and an omnidirectional antenna 16 for implementing prior art radio direction finding techniques is that apparatuses such as radio direction finding antenna apparatus 10 are bulky. In the present market, smaller apparatuses are sought, so it is advantageous to be able to accomplish required operations using more compact apparatuses. There is a need for a compact apparatus for effecting radio direction finding operations to ascertain angle of arrival of electromagnetic signals at an antenna.

The present invention provides significant improvements over prior art radio direction finding apparatuses and methods in ascertaining angle of arrival of electromagnetic signals. The present invention employs a characteristic electromagnetic signal. For purposes of this application a characteristic electromagnetic signal has at least one signal characteristic that experiences inversion or another detectable change when the signal is received by various portions of an antenna element. By way of example and not by way of limitation, a signal characteristic may include phase, polarization, or amplitude. Also by way of example and not by way of limitation, a characteristic electromagnetic signal may be a broadband electromagnetic signal having a characteristic Gaussian doublet type waveform in the time domain. Such Gaussian doublet waveforms are recognizable as having either an upright (or positive) orientation or an inverted (or negative) orientation. Further, such Gaussian doublet waveforms are known to exhibit 180 degree inversion in signals received or transmitted by a first half-plane of a planar loop antenna element compared with signals received or transmitted by a second half-plane of a planar loop antenna. For purposes of this application, the term "broadband signal" refers to a signal having a sufficiently broad bandwidth to permit detection of a change in a signal characteristic of an electromagnetic signal interacting with (i.e., received or transmitted by) an antenna element. For purposes of this application, the term "broadband antenna" refers to an antenna signal having a sufficiently broad signal response to permit detection of a change in a signal characteristic of an electromagnetic signal interacting with (i.e., received or transmitted by) the antenna element.

Figure 3:
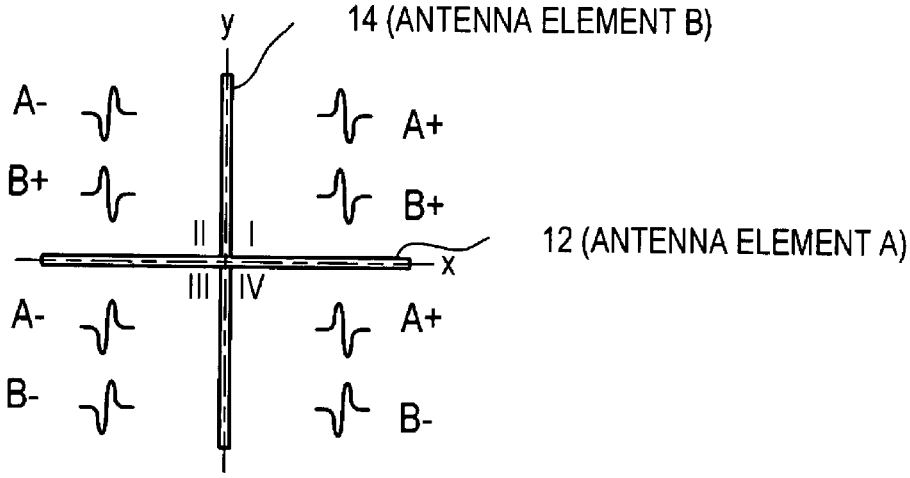
FIG. 3 is a schematic diagram illustrating patterns of waveform inversions related to quadrant of arrival of an electromagnetic signal at an orthogonal loop antenna of the type illustrated in FIG. 1.

FIG. 3 is a schematic diagram illustrating patterns of waveform inversions related to quadrant of arrival of an electromagnetic signal at an orthogonal loop antenna of the type illustrated in FIG. 1. In FIG. 3, antenna elements 12, 14 (FIG. 1) are shown in a top view with their associated axes x, y. A broadband electromagnetic signal containing a Gaussian doublet is received by antenna elements 12, 14. Antenna elements 12, 14 establish sectors or quadrants I, II, III, IV. For purposes of succinctly describing operation of the apparatus illustrated in FIG. 3, antenna element 12 will be referred to as ANTENNA ELEMENT A and antenna element 14 will be referred to as ANTENNA ELEMENT B.

FIG. 3 presumes that an exemplary electromagnetic signal is received by each of ANTENNA ELEMENT A and ANTENNA ELEMENT B in quadrant I as an upright (positive) signal characteristic. Thus in FIG. 3, quadrant I indicates that ANTENNA ELEMENT A receives a positive Gaussian doublet (indicated as A+) and ANTENNA ELEMENT B receives a positive Gaussian doublet (indicated as B+).

Quadrant II lies on a different side of axis y than quadrant I; that is quadrant II is in a different half-plane of ANTENNA ELEMENT A than quadrant I. It is for this reason that the Gaussian doublet of the electromagnetic signal received (or transmitted) by ANTENNA ELEMENT A is inverted (negative) in quadrant II (indicated as A−). In contrast, quadrant II lies on the same side of axis x as quadrant I; that is, quadrant II is in the same half plane of ANTENNA ELEMENT B as quadrant I. It is for this reason that the Gaussian doublet of the electromagnetic signal received (or transmitted) by ANTENNA ELEMENT B is upright (positive) in quadrant II (indicated as B+).

Quadrant III lies on a different side of axis y than quadrant I; that is quadrant II is in a different half-plane of ANTENNA ELEMENT A than quadrant I. It is for this reason that the Gaussian doublet of the electromagnetic signal received (or transmitted) by ANTENNA ELEMENT A is inverted (negative) in quadrant III (indicated as A−). Quadrant III lies on a different side of axis x as quadrant I; that is, quadrant III is in a different half plane of ANTENNA ELEMENT B as quadrant I. It is for this reason that the Gaussian doublet of the electromagnetic signal received (or transmitted) by ANTENNA ELEMENT B is inverted (negative) in quadrant III (indicated as B−).

Quadrant IV lies on the same side of axis y as quadrant I; that is quadrant IV is in the same half-plane of ANTENNA ELEMENT A as quadrant I. It is for this reason that the Gaussian doublet of the electromagnetic signal received (or transmitted) by ANTENNA ELEMENT A is upright (positive) in quadrant IV (indicated as A+). In contrast, quadrant IV lies on a different side of axis x as quadrant I; that is, quadrant IV is in a different half plane of ANTENNA ELEMENT B as quadrant I. It is for this reason that the Gaussian doublet of the electromagnetic signal received (or transmitted) by ANTENNA ELEMENT B is inverted (negative) in quadrant IV (indicated as B−).

Thus, each respective sector or quadrant I, II, III, IV is uniquely identified by the characteristic Gaussian doublet of the received (or transmitted) electromagnetic signal. Thus, ascertaining the combination of states of Gaussian doublets of the received (or transmitted) electromagnetic signal by each of ANTENNA ELEMENTS A, B permits ascertaining angle of arrival of the electromagnetic signal at least to a resolution of one quadrant I, II, III, IV.

A radio transmission and reception system for use in conjunction with the present invention may benefit from employing an original transmit broadband signal with a reference: a predetermined signal characteristic or combination of signal characteristics employed as a reference signal. Such a reference may assist a receiver in distinguishing which of a first or second state is indicated.

Figure 4:
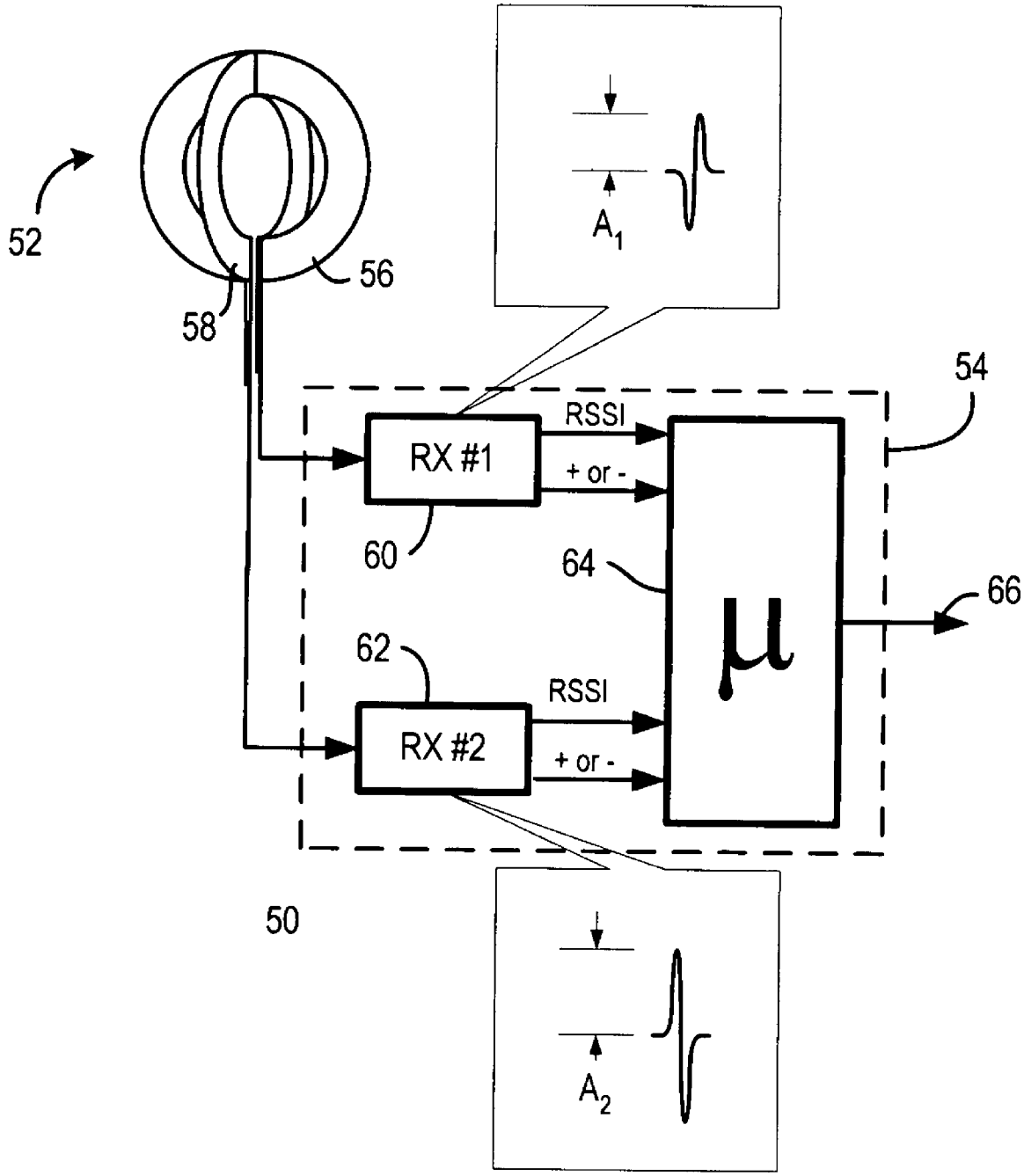
FIG. 4 is a schematic diagram illustrating details of the preferred embodiment of an evaluation apparatus useful in the system of the present invention.

FIG. 4 is a schematic diagram illustrating details of the preferred embodiment of an evaluation apparatus useful in the system of the present invention. In FIG. 4, a direction finding system 50 includes an antenna array 52 and an evaluation apparatus 54. Antenna array 52 includes a first antenna element 56 and a second antenna element 58. A first antenna element 56 and a second antenna element 58 are shown as planar loop antennas. A wide variety of other antennas are suitable for use in antenna array 52. One advantage of planar loop antennas, however, is that these antennas may be made arbitrarily small, limited only by a sensitivity of receiver units 60, 62 in properly detecting signals from antenna elements 56, 58. Thus, an antenna array 52 may be made very compact.

Evaluation apparatus 54 includes a first receiver unit 60, a second receiver unit 62 and a processor unit 64. First receiver unit 60 is coupled with one antenna element 56, 58 and second receiver unit 62 is coupled with another antenna element 56, 58 than is coupled with first antenna element 60. Each of receiver units 60, 62 provides information relating to signals received from its respective coupled antenna element 56, 58 to processor unit 64. Preferably, receiver unit 60, 62 provide information relating to signal amplitude or strength (e.g., RSSI; Received Signal Strength Indication) and signal orientation (e.g., Gaussian doublet upright [+] or inverted [−]) information.

Processing unit 64 employs predetermined relationships, preferably algorithmic relationships, for determining in which sector (FIG. 3) the signal arrived (or was transmitted). Processor unit 64 may interpret the combination of orientations of Gaussian doublets received by antenna elements 56, 58 to ascertain in which sector the signal arrived. In the representative situation illustrated in FIG. 5, first receiver unit 60 receives a first signal from antenna element 56 that has an amplitude $A_1$ and is an inverted Gaussian doublet. Second receiver unit 62 receives a second signal from antenna element 58 that has an amplitude $A_2$ and is an upright Gaussian doublet. By such determinations, processor unit 64 may ascertain angle of arrival of a signal at direction finding system 50 to a resolution of one sector (FIG. 3). Further, by comparing signal amplitudes of arriving signals, processor unit 64 may ascertain which arriving signals are directly received from a distal transmitter and which signals are received along a multi-path route having reflected off of an obstacle such as a building or other structure en route from the distal transmitter to direction finding system 50. Processor unit 64 presents an output signal at an output locus 66 to indicate conclusions regarding signals arriving at antenna elements 56, 58.

Figure 5:
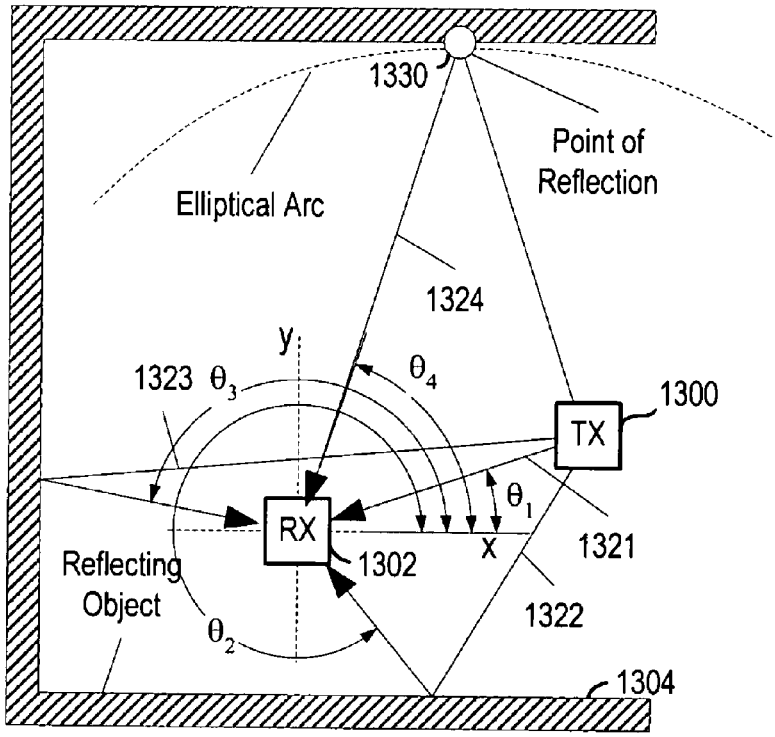
FIG. 5 illustrates shows a transmitter and a receiver employed according to the teachings of the present invention.

FIG. 5 illustrates shows a transmitter and a receiver employed according to the teachings of the present invention. In FIG. 2, a transmitter 1300 radiates a transmitted waveform at a time $t_0$ a receiver 1302. By way of illustration and not by way of limitation, transmitter 1300 and receiver 1302 are in the vicinity of a reflecting object 1304 thus creating a multi-path propagation environment in which receiver 1302 captures radio wave signals from a first signal path (1321), a second signal path (1322), a third signal path (1323), and a fourth signal path (1324) with angles of incidence $\theta_1$, $\theta_2$, $\theta_3$, $\theta_4$. Signals traversing signal paths 1321, 1322, 1323, 1324 arrive at times $t_1$, $t_2$, $t_3$, $t_4$ after following paths of length $L_1$ (signal path 1321), $L_2$ (signal path 1322), $L_3$ (signal path 1323), $L_4$ (signal path 1324). Arrival times $t_1$, $t_2$, $t_3$, $t_4$ vary linearly with path lengths $L_1$, $L_2$, $L_3$, $L_4$, and complete signal paths 1321,1322, 1323, 1324 at the speed of light c. Thus a measurement of arrival times $t_1$, $t_2$, $t_3$, $t_4$ also effectively measures path lengths $L_1$, $L_2$, $L_3$, $L_4$. Signal path 1321 is a direct, line-of-sight path. Signal paths 1322, 1323, 1324 are indirect propagation paths that involve a reflection or bounce. For example, signal path 1324 begins at transmitter 1300, continues to a point of reflection 1330, and further continues on to receiver 1302. For purpose of illustration, reflecting object 1304 is a single object such as a wall. A typical propagation environment may be defined by a complicated combination of multiple reflecting objects such as reflecting object 1304.

Figure 6:
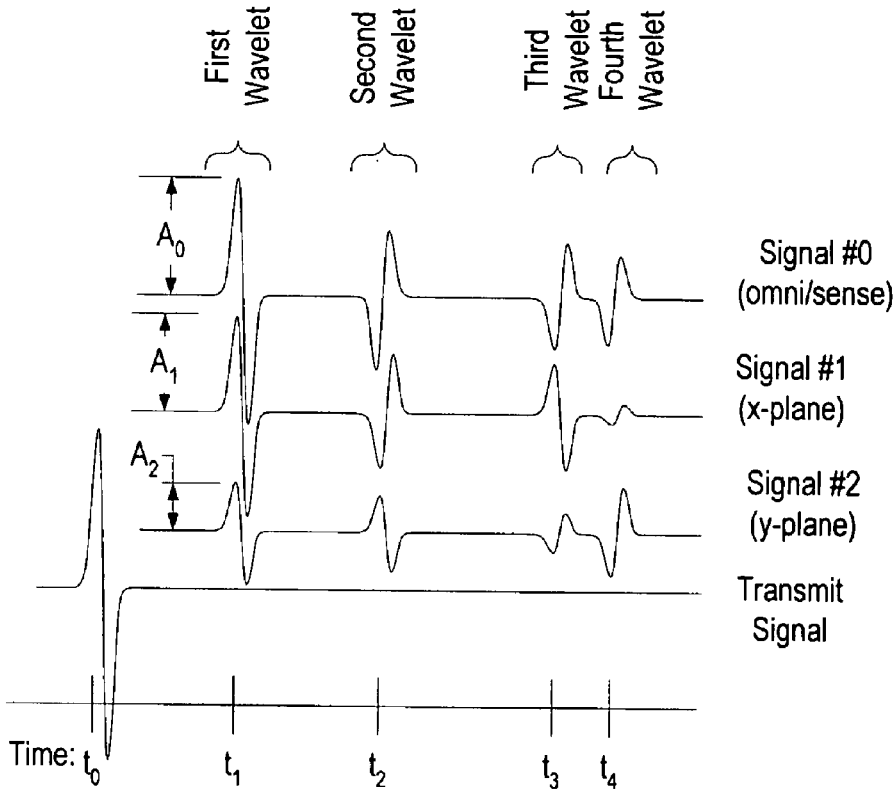
FIG. 6 illustrates a typical transmitted signal and received signals such as may be received by an antenna system as taught by the present invention.

FIG. 6 illustrates a typical transmitted signal and received signals in a multi-path environment such as may be received by an antenna system as taught by the present invention. In FIG. 6, a transmit signal is illustrated, and several received signals are illustrated representing how the transmit signal appears in representative antennas: a signal #0 received in an omni-directional sense antenna, Signal #1 with amplitude $A_1$ received in a first directional antenna sensitive in the ±x-direction and Signal #2 with amplitude $A_2$ received in a second antenna sensitive in the ±y-direction. These amplitudes $A_1$, $A_2$ are preferentially obtained from a direct, line-of-sight path such as a first signal path 1321 (FIG. 5). For ease of illustration, the transmit signal is depicted as a simple monocycle waveform, but any other waveform, pulse shape, or waveform packet may be used in conjunction with the present invention. Received signals such as Signal #0, Signal #1, and Signal #2 are composed of a variety of wavelets: a first wavelet due to a signal arriving from a first path, a second wavelet arriving from a second path, a third wavelet arriving from a third path, and a fourth wavelet arriving from a fourth path. As received by an omni-directional antenna in Signal #0, a first wavelet is due to a line-of-sight direct signal path and has an orientation substantially similar to the transmitted waveform. A second wavelet, a third wavelet, and a fourth wavelet are due to a second path, a third path, and a fourth path (respectively) that involve a single reflection. Thus, a second wavelet, a third wavelet, and a fourth wavelet are inverted relative to a first wavelet in Signal #0. Signal #1 and Signal #2 are composed of wavelets that may or may not be inverted depending on the combination of one or more inversions due to propagation path and inversions due to the behavior of the angle of arrival antenna system. For ease of illustration, a transmitted signal has been depicted only slightly larger than Signal #0, Signal #1, and Signal #2. Typically a transmit signal is much larger than a received signal.

Also for ease of illustration, Signal #1 and Signal #2 are scaled relative to Signal #0 under the assumption that the gain of a first directional antenna and a second directional antenna is substantially equivalent to the gain of an omni-directional sense antenna. In general, however, a first directional antenna and a second directional antenna will have a gain greater than an omni-directional sense antenna, and so Signal #1 and Signal #2 will have a greater amplitude (relative to Signal #0) than depicted.

The angle of arrival, subject to an ambiguity of quadrant (θ'), may be found from amplitude comparison:

$$\theta' = \arctan\frac{A_2}{A_1} \quad [4]$$

Following the teachings of the present invention, the quadrant of arrival may be determined unambiguously by a comparison of signal polarity, thus allowing for an unambiguous determination of angle of incidence, $\theta_1$.

Note that Signal #0 from an omni-directional sense antenna is not required to determine an angle of incidence $\theta_1$ if amplitudes $A_1$, $A_2$ are obtained from a first wavelet due to a direct, line-of-sight path (e.g., signal path 1321; FIG. 5). This angle of incidence from a direct, line-of-sight path $\theta_1$ (FIG. 5) is also an angular relationship $\theta_1$ of a transmitter relative to a receiver. An angular relationship $\theta_1$ in conjunction with a path length $L_1$, defines the position of a transmitter relative to a receiver. Thus, the present invention enables determination of the position of a transmitter without reliance on a multi-lateration calculation based on path lengths obtained from a network of path length measurements. Alternatively or in addition, the angle of arrival measurements possible using the present invention may be used to refine or improve a multi-lateration calculation based on path lengths obtained from a network of path length measurements.

If amplitudes $A_1$, $A_2$ are obtained from a second wavelet, a third wavelet, or a fourth wavelet, due to a second path (1322), a third path (1323), or a fourth path (1324) that are indirect propagation paths that involve a reflection or bounce, then a Signal#0 from an omni-directional sense antenna is useful. A Signal #0 exhibits the inversions due to the propagation path, allowing them to be distinguished from the inversions due to the function of the angle of arrival antenna system.

Thus, an angle-of-arrival antenna system does not require an omni-directional sense antenna but may benefit from one in the presence of significant multi-path signals.

Typically, a first directional antenna and a second directional antenna have higher gain than an omni-directional signal, so one or both of amplitudes $A_1$, $A_2$ will be larger than amplitude $A_0$. Thus a signal obtained from a combination of Signal #1 and Signal #2 is typically greater in amplitude than $A_0$.

A typical rake receiver takes a signal such as Signal#0 and detects and combines energy arriving at times $t_1$, $t_2$, $t_3$, $t_4$ so as to maximize a received signal to noise. The present invention enables a "spatial-rake receiver," one in which signals such as Signal#1 (S1) and Signal#2 (S2) are combined not only in time but also in space so as to create a received signal (S). If useful wavelets are found arriving at times $t_1$, $t_2$, $t_3$, $t_4$, a spatial rake might combine these signals as follows:

$$S=K_{11}S1|_{t_1\pm\Delta t}+K_{12}S2|_{t_1\pm\Delta t}+K_{21}S1|_{t_2\pm\Delta t}+K_{22}S2|_{t_2\pm\Delta t}+K_{31}S1|_{t_3\pm\Delta t}+K_{32}S2|_{t_3\pm\Delta t}+K_{41}S1|_{t_4\pm\Delta t}+K_{42}S2|_{t_4\pm\Delta t} \quad [5]$$

where $S1|_{t_1\pm\Delta t}$ is Signal #1 evaluated at times within Δt of $t_1$ so as to capture energy in a first wavelet, $S2|_{t_3\pm\Delta t}$ is Signal #2 evaluated at times within Δt of $t_2$ so as to capture energy in a second wavelet, and so on.

An exemplary spatial rake receiver might (for instance) construct a received signal (S) using angle of arrival information using coefficients:

$$K_{11}=\cos\theta_1,\ K_{21}=\cos\theta_2,\ K_{31}=\cos\theta_3,\ K_{41}=\cos\theta_4 \quad [6]$$

$$K_{12}=\sin\theta_1,\ K_{22}=\sin\theta_2,\ K_{32}=\sin\theta_3,\ K_{42}=\sin\theta_4 \quad [7]$$

In effect, these coefficients are equivalent to a rotation of a virtual antenna pattern oriented according to a choice of angle—thus making a receiver more or less sensitive in particular directions. In general however, a spatial rake receiver would use angle of arrival information as a starting point and vary the coefficients depending on the idiosyncrasies of the noise and interference environment so as to maximize the signal to noise ratio of received signal S. Additionally, a spatial rake receiver might act so as to minimize the impact of an interfering signal arriving from a particular direction by orienting a null of a virtual pattern so as to minimize sensitivity of a receiver to signals arriving from a direction in which there is undesired interference. Note that a spatial rake receiver as envisioned by the present invention does not require an omni-directional sense antenna.

If an indirect propagation path involves a single reflection or bounce such as a fourth signal path 1324 (FIG. 2), then a point of reflection must lie on an elliptical arc defined by foci at transmitter 1300 and receiver 1302 and by the path length $L_4$. If an angle of incidence $\theta_4$ is known, then the position of a point of reflection may be unambiguously identified. Thus, an angle of arrival system as taught by the present invention can identify the specific location of a point of reflection.

In a static environment the present invention may be used in conjunction with a radar intrusion detection system, allowing such a system to identify the specific location of an intruder. An object moving within the propagation environment between a transmitter and a receiver may be tracked using an angle of arrival system as taught by the present invention. Also, the location of walls or other static reflecting objects in the propagation environment may be determined.

In a dynamic environment with either a moving transmitter, a moving receiver, or both, a transmitter and a receiver with an angle of arrival system as taught by the present invention can compile data regarding the location of a point of reflection and create a radar map of the surrounding environment.

The present discussion has focused on use of an angle of arrival antenna system acting as a receiver. This does not preclude applying the teachings of the present invention in conjunction with transmission. By the principle of reciprocity for instance, an antenna system of the kind taught by the present invention can transmit a time-reversed signal with relatively dispersed energy with respect to time and result in a concentrated energy or impulsive signal at a receiver. Similarly, just as the present invention can reduce sensitivity of a receiver to interference by orienting a null of a virtual antenna pattern in a particular direction, so also can the present invention reduce transmitted power in a particular direction to avoid interference with a friendly receiver known to lie in that direction.

Figure 7:
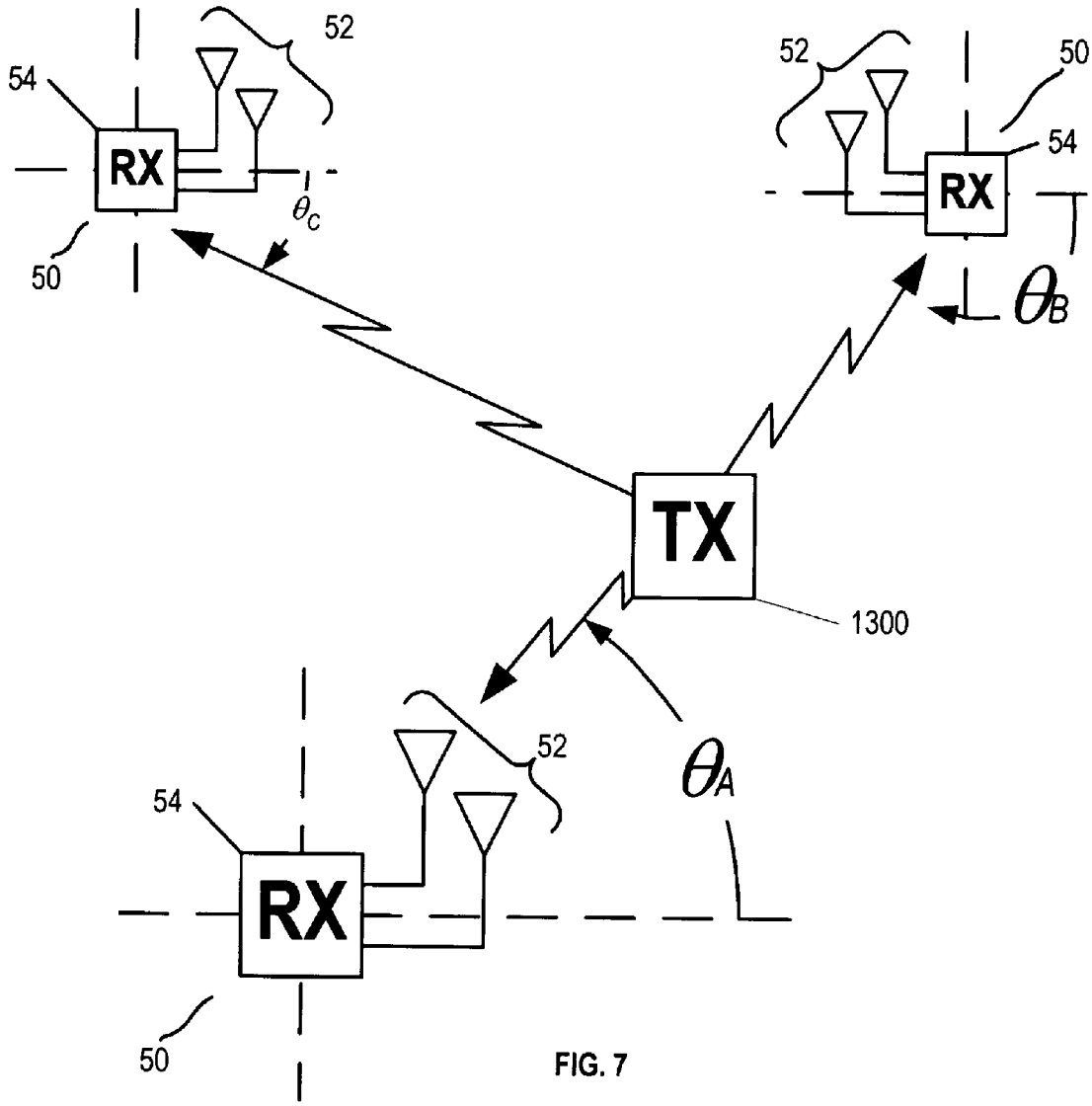
FIG. 7 shows a small aperture UWB localizing system whereby a transmit tag is located using a variety of angle-of-arrival evaluation apparatuses.

FIG. 7 shows a small aperture broadband localizing system whereby a transmit tag 1300 is located using a variety of angle-of-arrival (AoA) receivers 50. Angle-of-arrival evaluation apparatuses 50 employ antenna arrays 52 and evaluation apparatuses 54 to compare phase, timing, amplitude, or other signal characteristics to yield AoA measurements such as $\theta_A$, $\theta_B$, and $\theta_C$. These AoA measurements may be used either alone or in conjunction with ranging, differential time-of-arrival (DTOA) or other localizing techniques to yield a location for transmit tag 1300. Transmit tag 1300 may emit a broadband, ultra-wideband, or other signal useful for enabling localization of transmit tag 1300.

In a preferred embodiment, transmit tag 1300 emits a broadband electromagnetic signal—one with a fractional occupied bandwidth greater than about 5% where fractional occupied bandwidth bw is defined as $$bw=100\%\,BW/f_C \quad [8]$$

where bandwidth is the difference between higher and lower frequencies $BW=f_H-f_L$, where the center frequency $f_C$ is the geometric mean of the higher and lower frequencies $f_C=\mathrm{Sqrt}(f_H-f_L)$ and where the upper and lower frequencies bound 90% of the broadband signal energy.

Antenna arrays 52 are compact, comprising substantially co-located or adjacent located antennas. In the context of the present invention, antenna elements may be considered to be compact or "small aperture" if a characteristic spacing or dimension describing the separation of antenna elements is comparable in size or not significantly larger to a characteristic size or scale of the antenna element.

Figure 8:
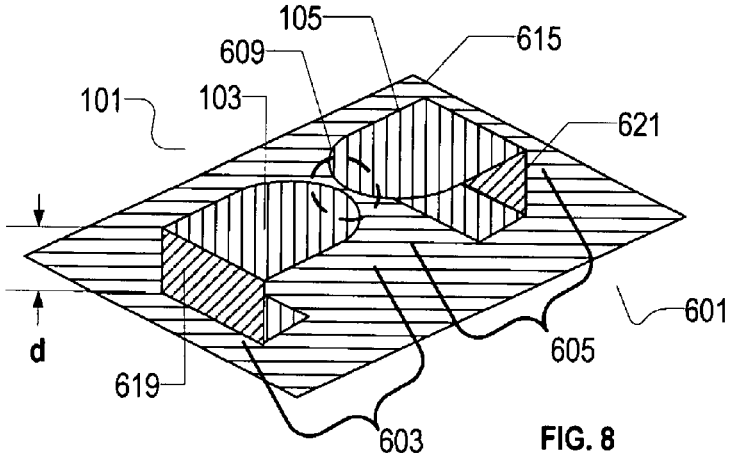
FIG. 8 is a schematic diagram of a backplane coupled reflector antenna system.

FIG. 8 is a schematic diagram of a backplane coupled reflector antenna system 601. Backplane coupled reflector antenna system 601 comprises planar dipole 101 with elliptically tapered semi-circular elements, a backplane 615, a first coupling means 619, and an optional second coupling means 621. Planar dipole 101 further comprises first elliptically tapered semi-circular element 103, and second elliptically tapered semi-circular element 105.

Alternatively, backplane coupled reflector antenna system 601 may be thought of as comprising first element 603, second element 605, backplane 615 and feed region 609. First element 603 comprises first elliptically tapered semi-circular element 103 and first coupling means 619. First elliptically tapered semi-circular element 103 is substantially co-planar with backplane 615. Similarly, second element 605 comprises second elliptically tapered semi-circular element 105 and second (optional) coupling means 621.

First elliptically tapered semi-circular element 103 is separated by a spacing d from backplane 615. Spacing d is typically between 0.1λ and 0.3λ where λ is the wavelength at a frequency of interest, such as the center frequency of a relevant broadband signal.

First elliptically tapered semi-circular element 103 is electrically coupled to first coupling means 619. Electrical coupling may include direct attachment (for instance by soldering), capacitive coupling, or first elliptically tapered semi-circular element 103 and first coupling means 619 may form one continuous conducting surface. In alternate embodiments, first elliptically tapered semi-circular element 103 and first coupling means 619 may further comprise a dielectric substrate, particularly a flexible dielectric substrate with a gradual curve between a portion of a dielectric substrate's metallization serving as a first elliptically tapered semi-circular element 103 and a portion of a dielectric substrate's metallization serving as a first coupling means 619. First coupling means 619 is electrically coupled to back plane 615. Electrical coupling may include direct attachment (for instance by soldering), or capacitive coupling (for instance by mechanically placing a substantial area of first coupling means 619 in close proximity to back plane 615).

Feed region 609 couples to a feed line such as a coaxial line or to an alternate feed line such as a micro-strip, stripline, or co-planar waveguide. First coupling means 619 provides a potential routing for a feed line. If feed region 609 and first coupling means 619 share a common flexible dielectric, a feed line may be embedded in a flexible dielectric.

In alternate embodiments, second elliptically tapered semi-circular element 105 may be similarly electrically coupled to optional second coupling means 621, and second coupling means 621 may be similarly electrically coupled to back plane 615.

Figure 9:
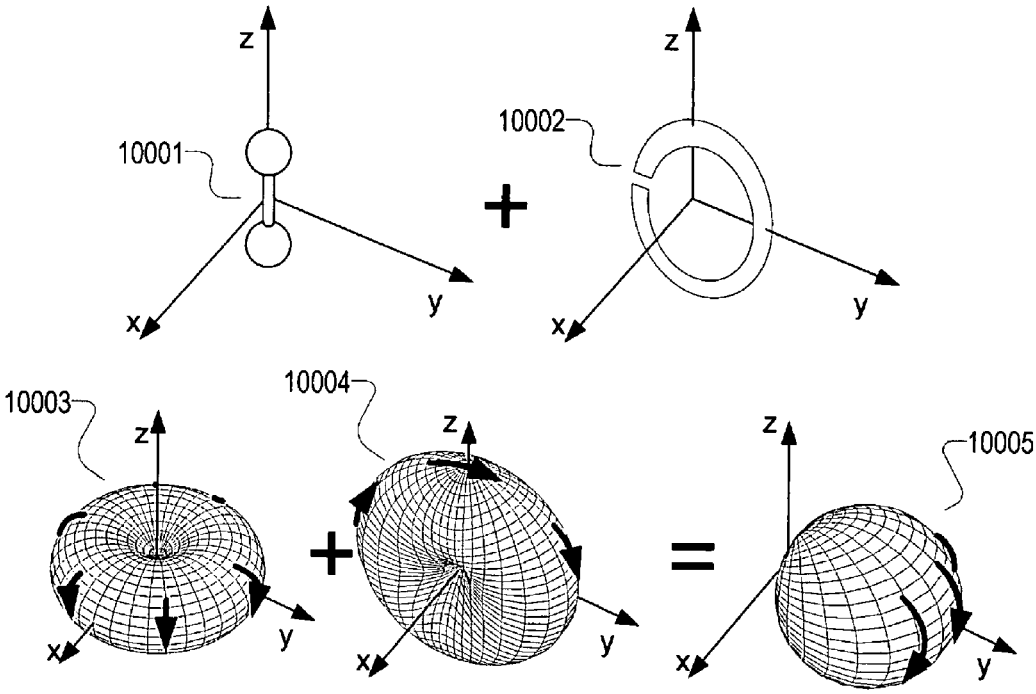
FIG. 9 is a schematic diagram illustrating superposition of electric and magnetic elements to create a cardiod pattern.

FIG. 9 is a schematic diagram illustrating superposition of electric and magnetic elements to create a cardiod pattern. An elemental electric dipole 10001 may be combined with an elemental magnetic loop 10002. An elemental electric dipole 10001 has electric dipole pattern 10003. An elemental magnetic loop 10002 has magnetic loop pattern 10004. When electric dipole pattern 10003 is combined with magnetic loop pattern 10004, the result is cardiod pattern 10005. Arrows on electric dipole pattern 10003, magnetic loop pattern 10004, and cardiod pattern 10005 denote characteristic directions of electric field polarization. Patterns combine constructively so as to reinforce where arrows are aligned and destructively to cancel out where arrows oppose. Cardiod pattern 10005 is particularly effective in the context of a transmit tag antenna because it is directive, focusing energy in the +y direction and away from a body or object in the −y direction on which a transmit antenna may be fixed or mounted.

Figure 10:
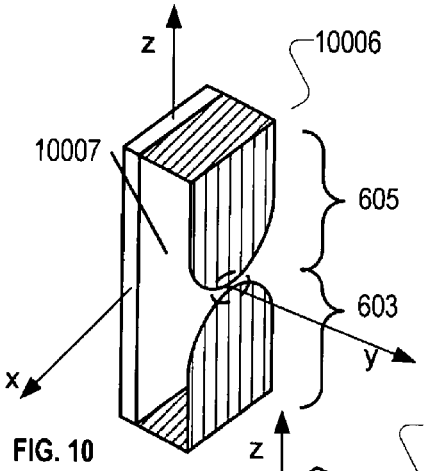
FIG. 10 shows a preferred embodiment transmit tag antenna for use in a small aperture UWB localizing system.

FIG. 10 shows a preferred embodiment transmit tag antenna 10006 for use in a small aperture UWB localizing system. Preferred embodiment transmit tag antenna 10006 may be combined with additional circuitry, battery, enclosure and other components to yield transmit tag 1300. In preferred embodiment transmit tag antenna 10006, backplane 615 is shrunk to yield compact backplane 10007. Compact backplane 10007 provides an electrical connection between first element 603 and second element 605. First element 603 and second element 605 cooperate to approximate elemental dipole 10001. Compact backplane 10007 cooperates with first element 603 and second element 605 to approximate elemental loop 10002. Thus, preferred embodiment transmit tag antenna 10006 yields a pattern approximately similar to cardiod pattern 10005. Compact backplane 10007 may further serve as a ground plane for circuitry associated with transmit tag 1300.

Figure 11:
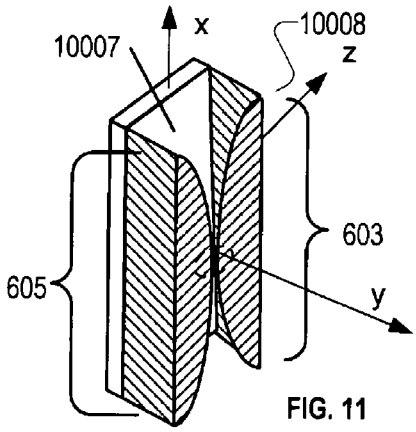
FIG. 11 shows a first alternate embodiment transmit tag antenna for use in a small aperture UWB localizing system.

FIG. 11 shows a first alternate embodiment transmit tag antenna 10008 for use in a small aperture UWB localizing system. First alternate embodiment transmit tag antenna 10008 may be combined with additional circuitry, battery, enclosure and other components to yield transmit tag 1300. First alternate embodiment transmit tag antenna 10008 is elongated along an x-axis and compressed along a z-axis. First alternate embodiment transmit tag antenna 10008 might be useful, for instance, if an x-axis were vertical to yield a horizontally polarized signal oriented along a horizontal z-axis.

Figure 12:
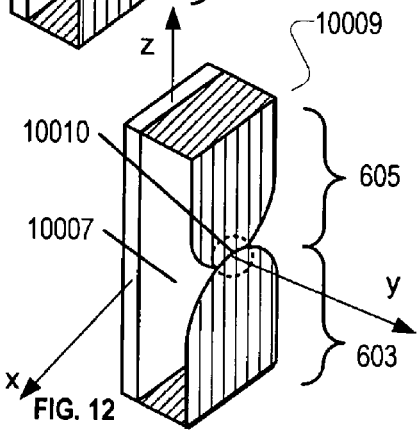
FIG. 12 shows a second alternate embodiment transmit tag antenna for use in a small aperture UWB localizing system.

FIG. 12 shows a second alternate embodiment transmit tag antenna 10009 for use in a small aperture UWB localizing system. Second alternate embodiment transmit tag antenna 10009 is characterized by an overlapping feed region 10010 according to the teachings of applicant's copending "Offset overlapping slot line antenna apparatus" (Ser. No. 11/455,425) which is incorporated herein by reference. Overlapping feed region 10010 may be further designed to yield spectral filtering properties in accord with the teachings of applicant's "Nano-antenna apparatus and method" (U.S. Pat. No. 7,068,225) which is incorporated herein by reference.

Figure 13:
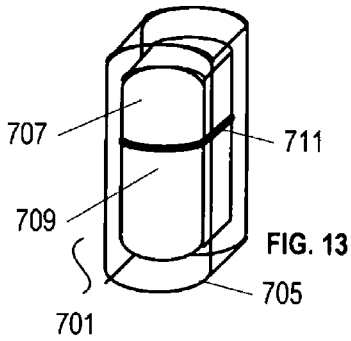
FIG. 13 shows a third alternate embodiment transmit tag antenna for use in a small aperture UWB localizing system.

FIG. 13 shows a third alternate embodiment transmit tag antenna 701 for use in a small aperture UWB localizing system. Third alternate embodiment transmit tag antenna 701 is a nano-antenna apparatus according to the teachings of applicant's copending "Tag-along microsensor device and method," (Ser. No. 11/474,770) which is incorporated herein by reference. Third alternate embodiment transmit tag antenna 701 comprises a dielectric layer 705, a first conducting surface 707 and a second conducting surface 709. A first conducting surface 707 and a second conducting surface 709 are separated by a gap region 711. Third alternate embodiment transmit tag antenna 701 has an approximately Cartesian rectangular solid form factor, preferred for many consumer devices. Various ratios of height to width to depth may be appropriate for various applications.

Figure 14:
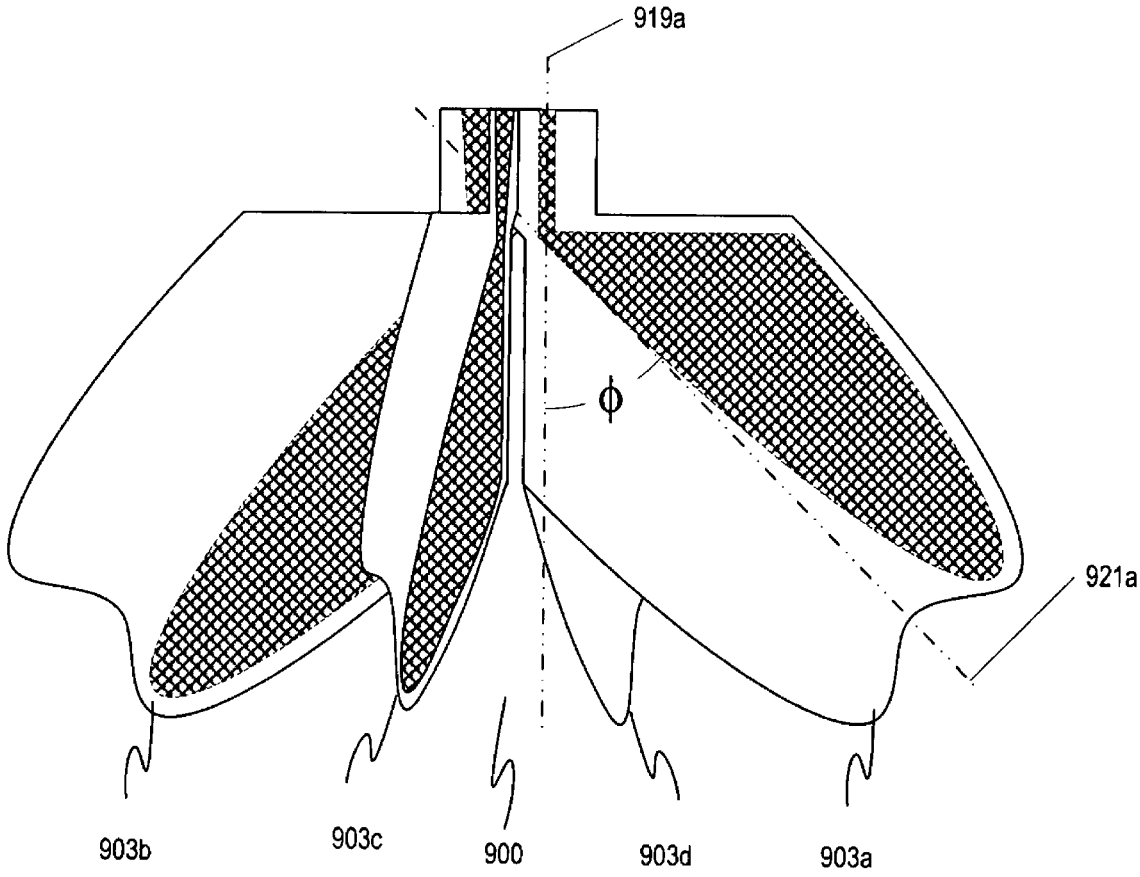
FIG. 14 shows a receive antenna array that might be used in the present invention.

FIG. 14 shows a side view of a receive antenna array 900 that may be used in conjunction with the present invention. Alternate embodiment 900 is an array comprising first antenna element 903*a*, second antenna element 903*b*, third antenna element 903*c*, and fourth antenna element 903*d*. First feed axis 919*a* and radiating axis 921*a* are oriented at angle $\phi$. Angle $\phi$ is preferentially chosen so as to align radiating axis 921*a* in a desired direction to optimize pattern orientation and maximize coverage. Other antenna element (903*b-d*) are similarly oriented. Alternate embodiment 900 is well suited for use in a compact ceiling mounted RF device.

Antenna elements (903*a-d*) have a beam width of no more than about 90 degrees. Thus four antenna elements (903*a-d*) are shown in alternate embodiment 900 to provide coverage in all directions. Additional elements may provide better coverage for additional cost and complexity. If the responses of antenna elements 903*a* and 903*b* are differentially combined, then antenna elements 903*a* and 903*b* are functionally equivalent to a first individual antenna element 56. Similarly, if the responses of antenna elements 903*c* and 903*d* are differentially combined, then antenna elements 903*c* and 903*d* are functionally equivalent to a second individual antenna element 58.

It is to be understood that, while the detailed drawings and specific examples given describe preferred embodiments of the invention, they are for the purpose of illustration only. In particular, the present invention describes AoA measurement in an particular (azimuthal) plane, however the teachings of the present invention can be readily extended to include AoA measure in an orthogonal (elevation) plane. The apparatus and method of the invention are not limited to the precise details and conditions disclosed and various changes may be made therein without departing from the spirit of the invention which is defined by the following claims:

I claim:

1. A small aperture broadband localizing system comprising:

one or more systems for ascertaining angle of arrival of an electromagnetic signal and at least one distal transmitter generating said electromagnetic signal, wherein each of said one or more systems for ascertaining angle of arrival of an electromagnetic signal further comprises an antenna array and an evaluation apparatus, wherein said evaluation apparatus determines said angle of arrival of said electromagnetic signal, wherein said antenna array is compact, and wherein said electromagnetic signal is a broadband electromagnetic signal.

2. A small aperture broadband localizing system as recited in claim 1 wherein said distal transmitter is a transmit tag further comprising a transmit tag antenna with a pattern approximately similar to a cardiod pattern.

3. A small aperture broadband localizing system as recited in claim 1 wherein said distal transmitter is a transmit tag further comprising a transmit tag antenna and wherein said transmit tag antenna further includes an overlapping feed region.

4. A small aperture broadband localizing system as recited in claim 1 wherein said distal transmitter is a nano-antenna apparatus, said nano-antenna apparatus further comprising:

a first conducting surface, a second conducting surface, a gap region between said first conducting surface and said second conducting surface; and at least one discharge switch.

5. A small aperture broadband localizing system comprising a transmitter and a system for ascertaining angle of arrival of an electromagnetic signal, said electromagnetic signal having at least one signal characteristic; said at least one signal characteristic indicating a first state or a second state; said system for ascertaining angle of arrival of an electromagnetic signal comprising:

(a) a plurality of n antenna elements intersecting a common axis and cooperating to establish 2n sectors; each respective sector of said 2n sectors being defined by two said antenna elements of said plurality of n antenna elements and said axis; said signal characteristic indicating said first state on a first side of each respective antenna element of said n antenna elements and indicating said second state on a second side of each said respective antenna element; combinations of said signal characteristics in each said respective sector uniquely identifying said respective sector; and (b) an evaluation apparatus coupled with at least two antenna elements of said plurality of n antenna elements; said evaluation apparatus employing said state of said signal characteristic sensed by each of said at least two antenna elements to effect said ascertaining angle of arrival to a resolution of at least one said respective sector.

6. A small aperture broadband localizing system as recited in claim 5 wherein said transmitter further comprises a transmit tag antenna with a pattern approximately similar to a cardiod pattern.

7. A small aperture broadband localizing system as recited in claim 5 wherein said transmitter further comprises a transmit tag antenna and wherein said transmit tag antenna further includes an overlapping feed region.

8. A small aperture broadband localizing system as recited in claim 5 wherein said transmitter is a nano-antenna apparatus, said nano-antenna apparatus further comprising:

a first conducting surface, a second conducting surface, a gap region between said first conducting surface and said second conducting surface; and at least one discharge switch.

* * * * *